United States Patent [19]

Wuethrich

[11] Patent Number: 4,735,344

[45] Date of Patent: Apr. 5, 1988

[54] DEVICE IN AN AUTOMATIC VENDING MACHINE FOR HOLDING OBJECTS DISPENSED BY THE LATTER

[75] Inventor: Werner Wuethrich, Gümligen, Switzerland

[73] Assignee: Autelca AG., Gümligen, Switzerland

[21] Appl. No.: 878,355

[22] Filed: Jun. 25, 1986

[30] Foreign Application Priority Data

Aug. 20, 1985 [CH] Switzerland ..... 357085

[51] Int. Cl.[4] ..... B65H 3/00

[52] U.S. Cl. ..... 221/194; 221/294; 194/202

[58] Field of Search ..... 221/12, 191, 193–196, 221/154, 256, 257, 294, 239, 312 R; 194/202; 49/68, 94, 101, 100, 114, 108, 109, 67, 62, 65, 63, 69, 104, 107; 312/291

[56] References Cited

U.S. PATENT DOCUMENTS 3,344,953 10/1967 Krakauer ..... 221/75

4,094,440 6/1978 Lotspeich ..... 221/12

4,180,183 12/1979 Muller ..... 221/194

4,296,872 10/1981 Mitchell et al. ..... 221/195

*Primary Examiner*—Joseph J. Rolla

*Assistant Examiner*—David H. Bollinger

*Attorney, Agent, or Firm*—Brady, O'Boyle & Gates

[57] ABSTRACT

The objects drop into a tray (1) from which they can be removed through a dispenser opening (2), the latter being closed by a first flap (3) that gives way when one reaches therethrough. Behind this flap (3), a second flap (17) is arranged which blocks the path (14) along which the objects pass into the tray (1) once the first flap (3) has left its rest position, and maintains this path closed until the first flap (3) has returned into its rest position. For this purpose, the first flap (3) forms the driving member, and the second flap (17) forms the driven member of a lever-cam gear with a rocker mechanism (15/16). A rocker arm (16) is guided along a cam (18) in such a way that the other rocker arm (15) repels the second flap (17) during opening of the first flap until it blocks the path (14). Until then, one rocker arm (16) closes off the interspace between the lower rim (22) of the first flap (3) and the lower rim (38) of the dispenser opening (2).

4 Claims, 2 Drawing Sheets

DEVICE IN AN AUTOMATIC VENDING MACHINE FOR HOLDING OBJECTS DISPENSED BY THE LATTER

The invention relates to a device for automatic vending machines which receive and hold objects dispensed by the machine and which block illegal entry up through the dispenser opening into the machine when the user reaches into the receiving and holding portion of the device. The objects are, for example, coins, especially change, or coins not accepted and therefore returned by the vending machine; in case of a coin changer, the coins issued; and, in case of an automatic vendor, also articles.

BACKGROUND OF THE INVENTION

As experience has shown, attempts are made to illegally reach through the dispenser opening into the automat, for example to prevent coins or goods from passing to their rightful owner and to seize them for oneself, or to obtain access to coins or goods not as yet dispensed by the automat.

For example, attempts are made to plug up the end of the coin return and/or issuance duct by a foreign body, e.g. a piece of elastic foam material, and to remove the foreign body after some time, so that all coins that have accumulated in front of the foreign body in the meantime will drop into the tray. Also, access is attempted to the coins present in the automat for issuing residual money or change, or to the articles or to the trigger mechanism for issuance of such articles, in order to remove coins or articles and/or trigger their issuance.

In addition to representing a property crime, such steps, even if unsuccessful, frequently result in operating disturbances and damage to the automat, particularly if tools or other auxiliary means are utilized on account of the cramped spaces making such interventions difficult.

The dispenser opening is the only opening of the automat housing which, in accordance with its intended use, must have a size adequate for reaching into it. Thus, it practically offers itself for abuse while, for example, coin insert slots, and slots through which, e.g., drive-through tickets are issued, are so narrow that they do not permit access into the interior of the automat.

SUMMARY OF THE INVENTION

The invention solves the problem of providing a device of the type discussed above wherein it is possible to reach into the tray through the dispenser opening only for proper usage, but it is impossible to reach further into the automat in an abusive fashion.

The advantages attained by the invention are to be seen essentially in that the gate through which the objects pass into the tray is closed as early as during the beginning of the opening movement of the flap, while the flap still seals the dispenser opening at least almost, i.e. has left its rest position only to such slight extent that at most a narrow gap is formed between the rim of the dispenser opening and the flap, which gap is not large enough to permit, even with a tool, access to the tray and from there to the gateway.

For example, the lower rim of the dispenser opening can be so wide that such a gap is produced only once the flap has been pivoted into the opening direction to such a degree that the closure element maintains the gate in the closed position. In a special embodiment of the invention, a second closure element keeps this gap at least almost closed up until the first closure element has sealed the gateway.

As a result, it is possible to reach unhindered through the dispenser opening into the tray in order to withdraw the objects dispensed by the automat, but interventions by reaching through the dispenser opening into the interior of the automat, and operating disturbances and damage caused thereby to the automat, are reliably prevented except for the case where destructive force is applied, which latter case can be precluded only within limits by technical measures. Special embodiments of the invention and their advantages can be seen from the following description.

BRIEF DESCRIPTION OF THE DRAWINGS

The invention will be described in greater detail below with reference to drawings which show merely one embodiment. In the drawings.

DESCRIPTION OF THE PREFERRED EMBODIMENT

Figure 1:
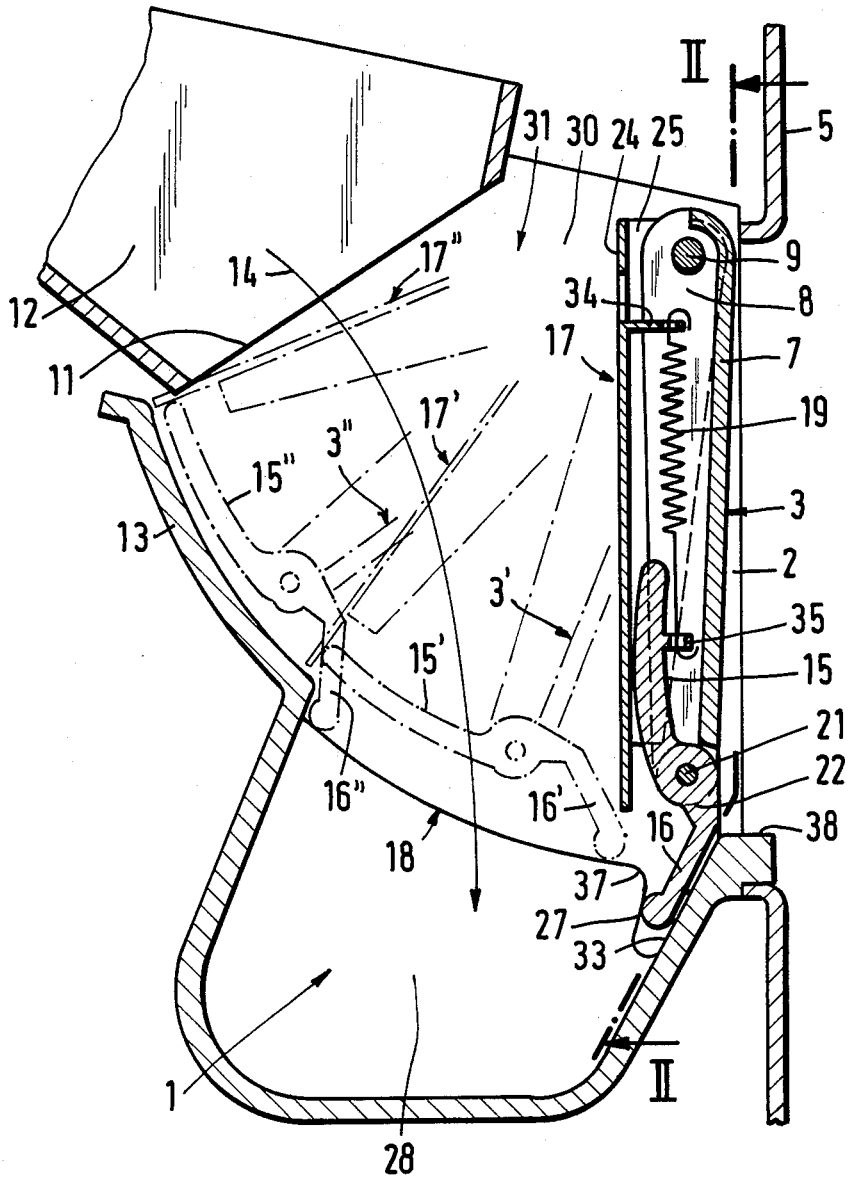
FIG. 1 illustrates a sectional view of a device according to this invention along line I—I in FIG. 2.

The figures show a device in connection with a money-operated automat which is not shown in greater detail, which device serves for holding and making available for dispensing coins issued by the automat (residual money, coins found to be unacceptable during coin checking, or change). This device consists in its basic structure of a tray 1 accommodating the issued coins and of a dispenser opening 2 equipped with a flap 3 which gives way when one reaches through the dispenser opening 2. The tray 1 is arranged behind the front wall 5 of the automat housing, the dispenser opening 2 being formed directly above the tray 1. The flap 3 has the form of a plate 7 with ribs 8 projecting rearwardly beside the vertical edges of the flap; these ribs are provided at the top with a bore for a pivot axle 9. The flap 3 is maintained in its rest position, illustrated in solid lines, by a coil spring, not shown, which spring is under torsional stress during pivoting of the flap 3. Consequently, when one reaches through the dispenser opening 2, the flap gives way and then returns again into its rest position. The coins issued by the automat pass from the outlet 11 of a coin channel 12 through an intermediate channel section 13 into the tray 1. The route of these coins (with the flap 3 being closed) is illustrated by an arrow 14.

The device of this invention comprises a structural array 15–19, the essential parts of which are a rocker mechanism or means 15/16, a second flap 17, two guide cams 18, and a tension spring 19. The rocker mechanism 15/16 is connected by a joint (hinged shaft 21) to the lower rim 22 of the first flap 3. The second flap 17 consists of a piece of sheet metal 24, beveled along its vertical edges, the beveled edges 25 of which are provided at the top with a bore for the swivel axle 9. The cams 18 constitute essentially (apart from an initial cam section 27) the upper rim of the sidewalls 28 of the tray 1. The first and second flaps 3 and 17 and the arm portion 16 of the rocker mechanism 15/16 are closely adjacent to the sidewalls 30 laterally defining the space 31 above the tray 1 and the intermediate channel section 13. In the rest position of the first flap 3, the second flap 17 and the rocker mechanism 15/16 are maintained in the position shown in solid lines in FIG. 1 by means of the spring 19. The arm portion 15 extends between the flaps 3 and 17, approximately in parallel to these flaps. The arm 16 extends closely along the upper rim of the frontal inner face 33 of the tray 1; the ends of this arm 16, which extend into the close proximity of the sidewalls 30, form levers urged against the initial portion 27 of the cams 18. For this purpose, the spring 19 is arranged between the two flaps 3 and 17 approximately in parallel thereto, and is connected at the upper end to an extension 34 of the second flap 17, at the lower end to an extension (rib) 35 of the rocker arm portion 15, this latter extension facing the flap 3.

The first flap 3 and the structural array 15–19 constitute a force-coupled lever-cam gear mechanism, the driving member of which is the first flap 3 and the driven member of which is the second flap 17, and wherein the spring 19 maintains the rocker arm 16, acting as a lever, in force-locking connection with the cam 18 and the rocker arm 15, likewise acting as a lever, in force-locking connection with the flap 17. Upon pivoting of the first flap 3 in the opening direction (in the clockwise direction according to FIG. 1), the rocker arm 16 first comes into contact tangentially with a cam curvature portion 37 adjoining the initial portion 27 of the cam, and subsequently the spring 19 maintains the free end of this arm 16 in force-locking connection with the portion of the cam 18 following the cam curvature 37 and being concentric to the swivel axle 9. At the same time, the rocker arm 15 is pivoted so that it pushes the second flap 17 away from the first flap 3 until the free end of this arm almost reaches the free end of the second flap 17. In this condition, the first flap is denoted, in FIG. 1, by 3', the second by 17', and the rocker mechanism with 15'/16'. During this movement, the gear ratio of the revolution of the second flap 17 with respect to the revolution of the first flap 3 is, at the beginning, substantially larger than one and then gradually drops to one, i.e. the second flap 17 is initially pivoted substantially faster than the first flap 3. In its position 17', the second flap 17 closes the intermediate channel section 13. And, until shortly before the end of the initial movement of the first flap 3 required for placing the second flap 17 into its position 17', the rocker arm 16 keeps closed the thus-formed interspace between the lower rim 22 of the first flap 3 and the lower rim 38 of the dispenser opening 2, so that it is practically impossible to reach through the dispenser opening 2 into the tray 1 and further into the intermediate channel section 13 and into the channel 12. Moreover, the objective can be achieved, for example by means of a somewhat longer lever arm length of the arm 15, that the arm 16 keeps this interspace closed even at the end of this initial movement of the first flap 3, in other words, the arm 15 has already attained its closed position 15' at the time the arm 16 detaches itself from the forward inner surface 33 of the tray 1.

Figure 2:
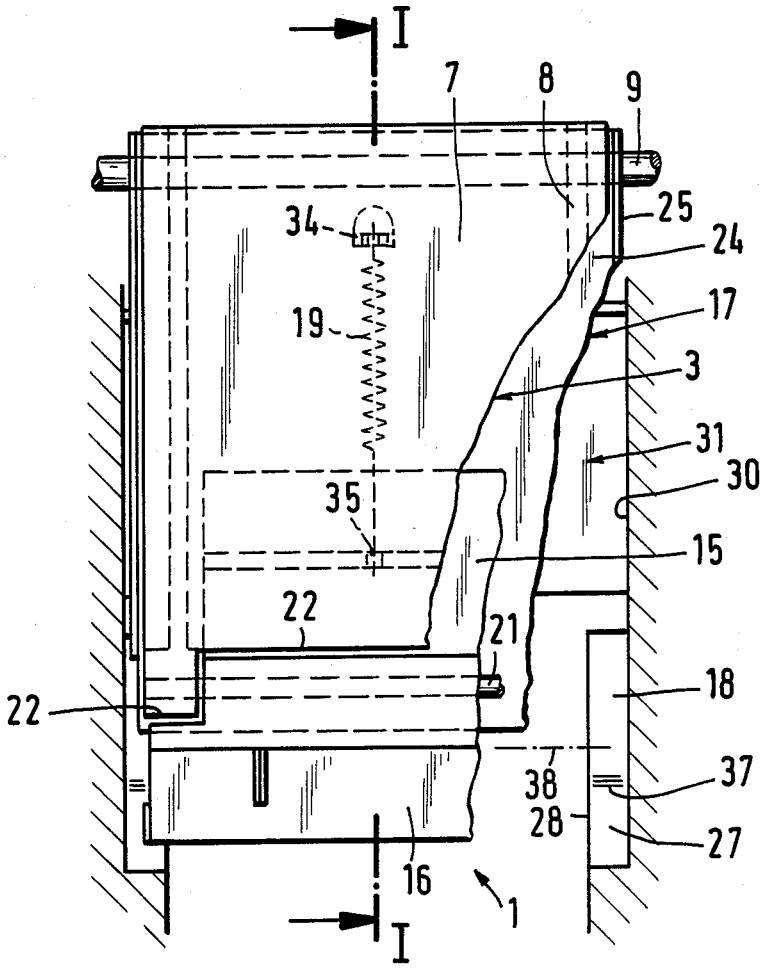
FIG. 2 shows a sectional view along line II—II in FIG. 2, portions thereof being depicted in broken-away illustration.

Since in the illustrated shape of the rocker mechanism 15/16, the arm 16 extends into the close proximity of the walls 30 and the arm 15 extends almost over to the walls 30 (FIG. 2), the rocker mechanism, in its position 15'/16', already prevents access to the intermediate channel section 13 and to the channel 12. However, without the second flap 17, coins dispensed by the automat would drop onto the arm 15' while the rocker mechanism is in its position 15'/16', and would jam, during the return pivoting of the flap 3, between the latter and the arm 15, which would lead to operating disturbances. Such disturbances are impossible on account of the second flap 17. Coins issued by the automat in the position 17' of the second flap, associated with the rocker mechanism position 15'/16', drop onto the second flap 17' and slide therealong downwards into the tray 1 when the first flap 3 pivots into its rest position.

There is the possibility, in the position 3' or in a position of the first flap which is still further pivoted in the clockwise direction, of introducing a hook-shaped instrument between the arm 16' and the lower rim 38 of the dispenser opening 2 into the tray 1 with the intent of moving the arm 15' so that the second flap 17' is swung back. However, the second flap, in this position 17', cannot be pivoted upwardly because the arm 16' is in contact with the cams 18, and it cannot be pivoted downwardly, either, because it would then abut against the lower wall of the intermediate channel section 13, on the left-hand side in FIG. 1. A downward swinging of the arm 15 into its position 15' could also be attained by a corresponding limitation of the rotational movement of the joint (the hinged shaft of which is denoted by 21), or by the feature of designing the cam gear 16/18 to be shape-mating instead of force-locking, as illustrated.

By pivoting the first flap 3 past its position 3' further into position 3'', it vacates the upper open side of the tray 1, as well as the space 31 located thereabove, for reaching into the tray 1, so that coins that have been issued by the automat and dropped into the tray 1 can be removed as usual. By thereafter releasing the first flap 3 in its position 3'', it returns into the rest position, and with it also the structural array 15–19, the passageway 14 between the tray 1 and the channel 12 remaining closed until the first flap has reached its rest position 3 at least almost completely.

I claim:

1. In an automatic vending machine a device for holding objects dispensed by the machine, having a dispenser opening (2) in the front wall (5) of the automatic vending machine;

a pair of side walls (30) laterally defining a space (31) at the inner side of said dispenser opening (2);

a tray (1, 28, 33) at an base of said space (31), having a pair of side walls (28) with a top portion, a front wall (33), and a rear wall (13);

a channel (12) having an outlet (11) for feeding objects dispensed by the machine to said space (31);

a first flap (3) pivoted about a horizontal axis (9) near a top of the dispenser opening (2) and normally positioned by gravity to close the dispenser opening(2), a second flap (17) pivoted about said horizontal axis (9) near the top of the dispenser opening (2), and positioned at the back of said first flap (3) normally substantially parallel thereto, and movable to an operative position (17'') in which it maintains closed said outlet (11) of said channel (12);

rocker means (15, 16) povoted about a second horizontal axis (21) at a lower end of said first flap (3), and having a first rocker arm portion (15) positioned between said first and second flaps (3, 17) and normally substantially parallel thereto, and a second rocker arm portion (16) on the opposite side of said second horizontal axis (21) from said first rocker arm portion (15); and a lead cam (18) on the top portion of at least one of said side walls (28) of said tray (1), having a first cam portion curved concentrically to said horizontal axis (9) of said second flap (17), and a downwardly curved second cam portion (37, 27) near said front wall (33) of said tray (1), said second rocker arm portion (16) having a side portion received between said downwardly curved second cam portion (37, 27) and said front wall (33) of said tray (1) when said rocker means (15, 16) is in a normally upright position between said first and second flaps, whereby upon movement of said first flap (3) said rocker means (15, 16) is pivoted by said lead cam (18) to move said second flap (17) toward the operative position (17″) thereof to maintain closed the outlet (11) of said channel (12) at the time when said first flap (3) is not at least approximately in its closed position.

2. A device as claimed in claim 1, including a tension spring (19) having one end connected to said second flap (17) near said horizontal axis (9) thereof, and the other end connected to said first rocker arm portion (15).

3. A device as claimed in claim 1, in which said rocker means (15, 16) having opposite ends which extend into close proximity to said side walls (30) of said space (31).

4. A device as claimed in claim 1, and said space (31) including an intermediate channel section (13) adjacent to said outlet (11) of said channel (12), and having a curved wall portion conforming to an arc swept by said second flap (17) when moving to its operative position (17″).

* * * * *